United States Patent [19]

Kawajiri et al.

[11] Patent Number: 4,788,811

[45] Date of Patent: Dec. 6, 1988

[54] PROCESS AND APPARATUS FOR ASSEMBLING AND LIQUOR-CHARGING OF PACKAGES OF PAPER AND THE LIKE

[75] Inventors: Ryoichi Kawajiri, Kawasaki; Masahiro Honda, Tokyo; Haruo Furukawa, Omiya, all of Japan

[73] Assignee: Dai Nippon Insatsu Kabushiki Kaisha, Tokyo, Japan

[21] Appl. No.: 49,343

[22] Filed: May 13, 1987

[30] Foreign Application Priority Data

May 17, 1986 [JP] Japan ..... 61-73371[U]
May 21, 1986 [JP] Japan ..... 61-114686
Jun. 9, 1986 [JP] Japan ..... 61-86557[U]

[51] Int. Cl.[4] ..... B65B 55/10; B65B 61/18

[52] U.S. Cl. ..... 53/426; 53/410; 53/471; 493/87; 493/165

[58] Field of Search ..... 53/426, 410, 486, 485, 53/471, 284, 133, 128; 493/87, 308, 452, 165, 164, 962

[56] References Cited

U.S. PATENT DOCUMENTS 3,144,816 8/1964 Walker et al. ..... 493/87 X
3,566,575 3/1971 Lisiecki ..... 53/426
4,386,923 6/1983 Okushita ..... 493/87
4,604,850 8/1986 Reil ..... 493/87 X
4,690,667 9/1987 Domke ..... 493/87 X

*Primary Examiner*—James F. Coan
*Attorney, Agent, or Firm*—Parkhurst, Oliff & Berridge

[57] ABSTRACT

The invention relates to an apparatus for the successive production of a number of paper packages fitted with respective spouts on a part of the top end portion thereof and charged with a liquid drink. The spout includes a spout proper having a general cylindrical outer configuration and formed generally therethrough with a liquid spouting passage provisionally closed or valved, and an attaching flange permanently fixed to the root end of the spout proper. For better sanitary purposes, the spout is introduced into the open end of a semipackage from inside thereof. The spout introduction and attaching job is carried out directly before charging with liquid. Only thereafter, liquid charging-in and top-closing jobs are carried out in a sterilized atmosphere. Within the sanitary execution of these jobs, the spout introducing and sealing attachment are included for increasing the sanitary safety.

12 Claims, 16 Drawing Sheets

PROCESS AND APPARATUS FOR ASSEMBLING AND LIQUOR-CHARGING OF PACKAGES OF PAPER AND THE LIKE

BACKGROUND OF THE INVENTION

1. Field of the Invention

The present invention relates to improvements in the processes and apparatuses for assembly and liquor-charging of paper packages.

2. Prior Art

Conventional bottles for preserving liquid drinks and the like are being more and more replaced by paper packages. This kind of container package is manufactured from the material carton stock, assembled into a semiassembled package or semipackage and then charged with the liquor to be contained and sealed off, for providing a liquid-containing package assembly as a final product package, and in a production line. In this way, a considerable reduction in its manufacturing cost can be realized. In addition, the used empty packages are collapsed into minimum possible volume wastes, which can be discarded with ease and convenience. These merits of paper packages have accelerated its broad use in recent decades.

It should be noted that nowadays provision is broadly made of spout means on the upper end portion of the paper package so as to make it easier to pour out the contained liquor and to assure sealing against leakage upon partial use of the contained liquor.

It is, however, a conventional practice to execute the spout-attaching job directly before the liquid-charging step with use of a liquid charging unit while the semipackage without spout is being carried along on a carrier means, and indeed, after execution of the package bottom assemblying step.

With employment of the foregoingly set forth conventional technique for attachment of a spout onto each of the paper semipackages directly before execution of liquid charging step, unavailable fouling problems will be invited. Or more specifically, since the spout-attaching unit is arranged on the stock-conveying line of a paper package stock-carrier unit, fouling parts of the spout-attaching unit may mostly be feared during and after the action of the liquid-charging unit, or conversely the latter unit may be fouled by contact with the spout-attaching unit when working in fouled conditions.

On account of the conventional provision of spout-attaching unit on the stock-carrier line, the latter line becomes longer than required. As an example, when a defective final product package attached with spout should have been found by inspector at the terminal end or so of the whole carrier line, more losses due to defective final products will be invited with increase in the length of the carrier line.

SUMMARY OF THE INVENTION

A main object of the invention is to obviate the foregoing conventional drawbacks by providing such a possibility as attaching the spout at an initial stage of assemblying both the ends of a hollow cylindrical semipackage.

Another object is to provide a unique technique for attaching a spout to the hollow cylindrical semipackage in a definitely reliable manner.

Still another object is to provide an improved technique for the execution of a bottom assembling job of the semipackage after attachment of a spout thereto, and in a most reliable manner and within a least possible space requirement.

According to the present invention, the foregoing objects may be attained by adopting such an improved process for assembling and liquor-charging of a series of paper-made or the like packages comprising a step for attaching a spout onto a closable top end portion of each of said packages in an successive order, said package having a hollow cylindrical main body and a closable top end and a closable bottom end, as extensions of said main body and the, outside and inside surfaces of said package being coated with a sealable and settable agent; a step for successively capping said hollow packages onto each of a plurality of radially extending and intermittently rotated mandrels in such a mode that said closable package bottom is directed radially outwards of said mandrels; a step for assembling the open package bottom of each of said packages in a successive order, while being held on and in said capped state; a step for discharging the thus bottom end assembled packages to a conveying carrier in a successive order; a step for charging a predetermined quantity of liquor to each for said bottom end assembled semipackages while being mounted on said conveying carrier; and a further step for assemblying and closing said closable open top end of each of said semipackages.

According to the invention, such an improved apparatus is proposed for satisfying several foregoing objects, as comprising: feeder means for feeding piecewise a series of paper-made semipackages held horizontal, each thereof having a closable open top end portion and a closable open bottom end portion, said top end portion being formed with a small lateral opening for later holding a spout; a holding unit holding piecewise said semipackages horizontally; a sucker shiftable relative to said semipackage held on said holding unit and partially projectable into the top end portion of said semipackage for introducing cylindrical main portion of a spout held on tip end of said sucker into said small lateral opening; means for fusingly attaching said spout onto said top end portion from inside of said hollow semipackage; a mandrel unit arranged in succession of said holding unit and having a plurality of radially extending mandrel arms and performing an intermittent rotary motion; means for causing the semipackage held on said holding unit and fitted with said spout to be capped on one arm of said mandrel unit in such a manner that said bottom end portion of said semipackage directs radially outwards; means for assembling said open semipackage bottom while the semipackage being mounted on said mandrel unit and subjected to an intermittent rotary motion thereof; a conveyor unit for conveying the bottom-assembled semipackage; means for holding said semipackage on said conveyor unit upright with its bottom end directing dowwards and for discharging said semipackage; a liquor-charging unit for charging a liquor into said semipackage through the top end thereof while the semipackage is being conveyed on said conveyor unit; and means for assembling the top end portion of said semipackage while the semipackage is being conveyed on said conveyor unit.

In the present invention, the semipackage is fitted with the spout and the thus provided intermediate semipackage is subjected in a sterilized chamber to several processing jobs, such as assembling and closing the open top end portion; sterilizing; liquor charging and sealing-off. In the sterilizing step, sterilization treatment of the semipackage proper as well as the attributed spout is executed, thus resulting in a highly reliable and safety sterilized semipackage per se. For the execution of the invention, a separate step for sterilization of the spout per se can be dispensed with. As a result, a highly compact and economical production plant can be provided, and indeed, the liquor charging may be carried into effect in a highly reliable sterilized manner.

In the present invention, several jobs for assembling of semipackage bottoms, liquor-charging and semipackage top-end sealing are executed on the semipackage stock. However, upon attachment of the spout, it is necessary to arrange any fouling means, indeed, in close proximity of the liquor-charger, and it is further possible to substantially shorten the overall production line including package-assembly and liquor-charging means, especially semipackage conveying line for conveying bottom-assembled semipackages. Even in occasional occurrence of defectively attached spouts, package stock loss may be reduced to a possible minimum. As a result, spouted paper packages of high sanitary quality can be produced in a highly efficient manner.

In the present invention, use is made of a rotary mandrel unit, having a plurality of radially extending mandrel arms which are adapted for cappedly receiving semipackages while being subjected to bottom assembly job, and indeed, in one-to-one relationship. By adopting such mandrel unit, the conveying line length for conveying semipackages while each being subjected to a bottom-end assemblying job, can be shortened substantially. With this improved arrangement, sanitary spout-fitted semi-packages can be manufactured in a highly economical way.

It is highly advantageous to cap the spout-fitted semipackage on each one of radially extending mandrel arms, and indeed, in such style or attitude of the semipackage that the flap surface to which a spout has been attached directs substantially in parallel to the rotary plane of the mandrel unit. By adopting such arrangement, semipackages can be discharged onto conveyor means, without being subjected to any change in the angular position of the semipackage. It is unnecessary to provide such means as above for change of semipackage angular position and otherwise to be arranged between said mandrel and conveyor. For this reason, the overall manufacturing plant can be made highly compact.

DETAILED DESCRIPTION OF PREFERRED EMBODIMENTS

Figure 1:
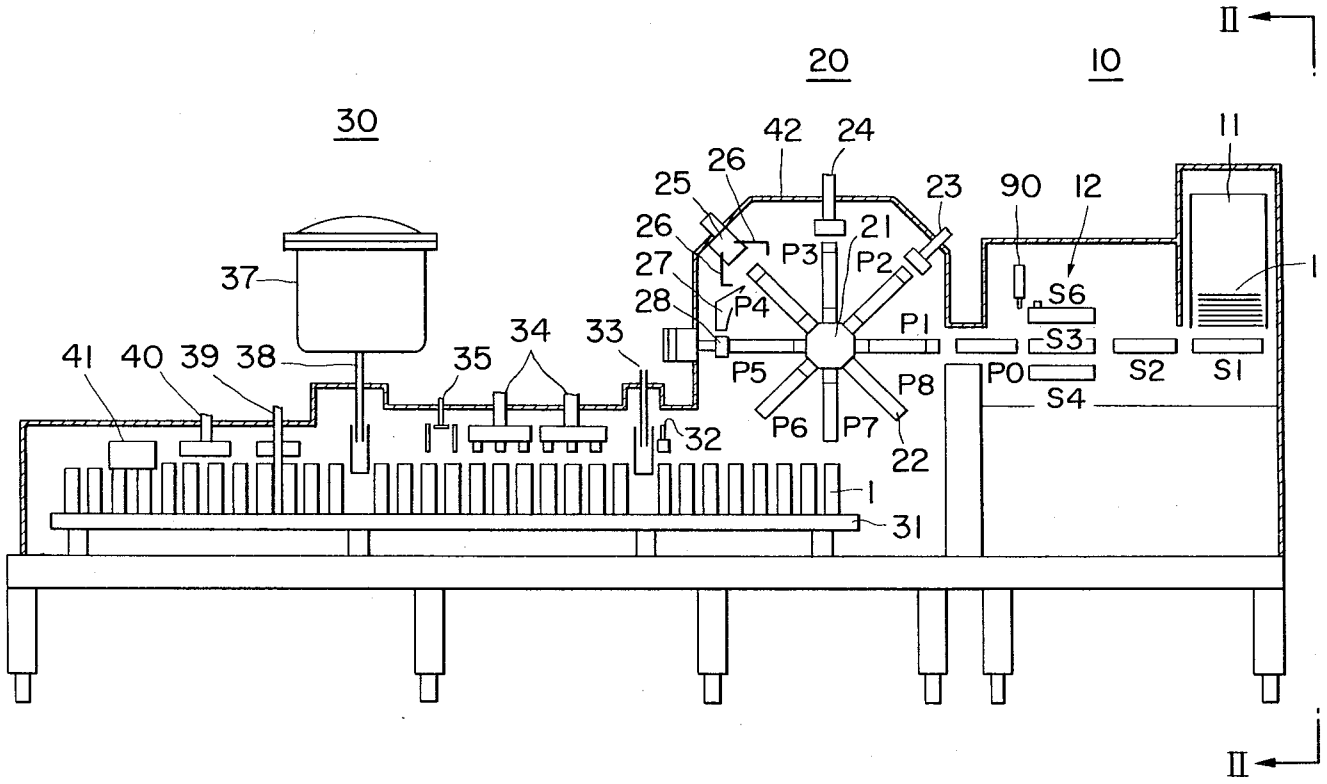
FIG. 1 is a schematic side elevational view of a preferred plant for the manufacture of a series of paper-made container packages, fitted with a unique spout attaching means.

Now, referring to the accompanying drawings, preferred embodiments of the invention will be described more in detail.

Before describing detailed structure and function of the inventive method as well as apparatus, a paper package proper 1 and a dispersing or pouring unit 2 to be attached thereto in accordance with the present invention will be set forth with reference to FIGS. 40 through 42, for better understanding of the invention. At the present stage, it should be noted that the paper package proper is illustrated with common reference numeral 1 throughout the present specification, regardless of the occasionally occupying specific and various shapes and states, such as its folded-down stock sheet state; an erected empty box-like state or a liquid-filled and pouring unit attached status as final product or so.

Figure 41:
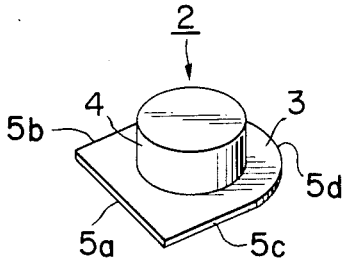
FIG. 41 is an enlarged perspective view of a spout.

As shown specifically in FIG. 41, the pouring unit 2 consists mainly of a flat base flange portion 3 and a short height cylindrical portion 4 attached thereto, said flange 3 being defined by a straight lateral edge 5*a*, a pair of straight and parallel side edges 5*b*; 5*c* and a semicircular edge 5*d* extending therebetween.

Figure 40:
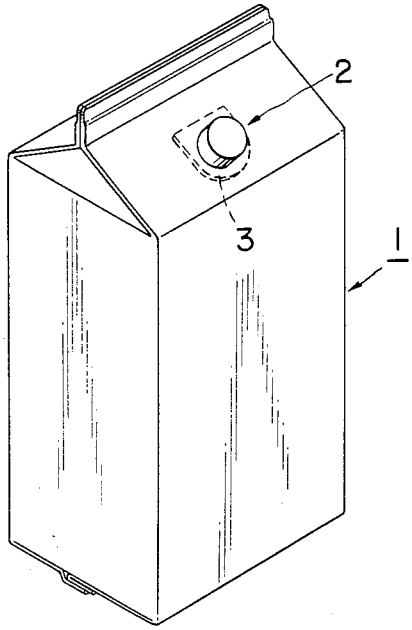
FIG. 40 is a perspective view of the final product of the package fitted with a spout and filled with a drink or the like liquor.

In FIG. 40, the final product attached with the pouring unit 2 onto one of top flaps and preferably filled therein with a proper liquor or drink, not shown, is illustrated. The package is also shown with same reference numeral 1, only for simplicity and convenience of the description and drawings.

Figure 42:
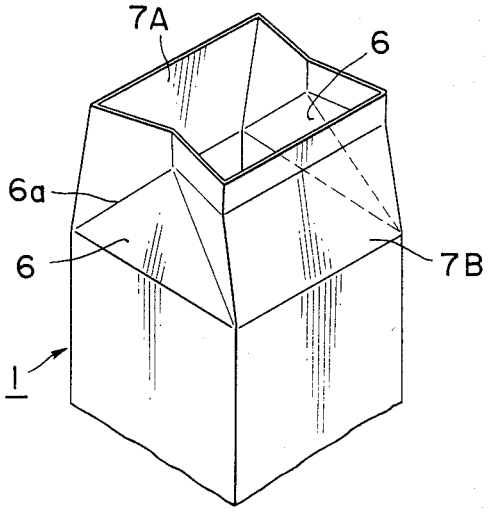
FIG. 42 is a perspective view of a bottom end portion of a semipackage, illustrating its top-and-bottom inverted position wherein the bottom end portion appearing in the drawing is not yet closed and kept in its opened state.

In FIG. 42, the bottom of the package 1 is illustrated in up-and-down state serving for better understanding.

As seen, there are formed triangular foldable lines as at 6*a* on one of side flap 6. In opposing arrangement, there is another symmetrical flap 6 having a similar triangular foldable lines, although not specifically denoted. There is further provided a pair of somewhat differently shaped bottom flaps 7A and 7B adapted for partially being overlapped one after another, as is clearly understood from FIG. 40. Naturally, all these bottom flaps are continuous to each other, as well as to the main box-like body of the package 1. This continuous feature is applied also to the top cover panels, not specifically reference-numbered, at this stage, even though appearing in FIG. 40.

Now, referring back to FIG. 1, numeral 10 represents a package stock supply section, which serves for attaching a pouring unit 2 to each of the package stocks 1 which have been prepared from paper boards as conventionally through several preforming steps such as press-forming of folding lines, folding and sticking to provide a hollow box structure opened at flapped ends and finally collapsing the hollow box under pressure to provide a continuous double-sheet package stock. Further, numeral 20 represents a package bottom assembler section adapted for assembly of the bottom flaps into final shape, as will be more fully described hereinafter.

Figure 2:
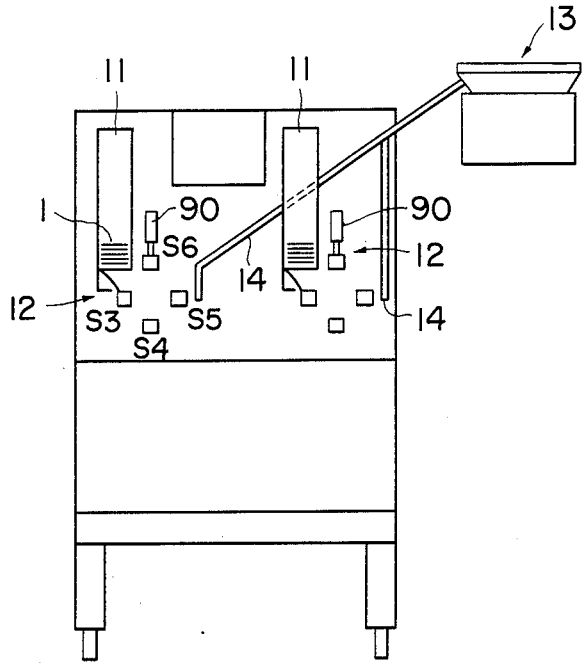
FIG. 2 is a schematic end elevation of the plant as viewed in the direction of arrows II—II shown in FIG. 1.

Numeral 30 represents a paper package-sterilizing, liquid-charging and top-sealing section, adapted successively for performing these jobs onto a number of paper packages. In FIG. 2, a schematic end view of this section 30 is shown, when seeing in the direction of small arrows II—II shown in FIG. 1.

The package stock supply section 1 comprises a stock feeder 11 in which a stack of flattened package stocks 1 is stored; a stock transfer unit for successive take-out of flattened paper stocks 1 from the feeder 11 and opening each of these stocks into a square-sectioned hollow pillar and shifting the latter successively onto a provisional station S1, said transfer unit being, however, not shown on account of its very popularity and for avoiding excess crowding of the drawing; a spout-attaching unit 12 for successive introduction of a spout unit 2 through the upper opening of each of said hollow pillar stocks 1, and attaching its flange portion 3 onto one of top flaps of the stock; a spout dispenser 13 for successive supply of spouts through chute means 14 to a proximity of spout-introducing position of the foregoing unit 12; and a package stock introducing and discharging unit, not shown, adapted for transfer of the package stock provisionally held at position S1 through S2 to the foregoing unit 12 and for feed-out of the package stock 1 attached with spout unit, towards the next succeeding processing stage. Although not shown, these related units are provided each in two parallel sets. Details of the spout-attaching unit 12 will be described more fully at a later stage of the description.

Package bottom assembler section 20 comprises a vertical type turret unit 21 including a plurality of radial mandrels as at 22 and arranged to perform an intermittent rotary motion; a package bottom folding and shaping unit 25; heaters 23 and 24 for applying heat to the bottom portion of the stock 1 and a pair of guide arms 26 and further guide means 27 as well as a package bottom-pressure former 28. These parts or units denoted with 23; 24; 25; 27 and 28 are arranged in proximity of outer ends of mandrels 22 at the intermittently stopping positions of the latter. As for the foregoing units 25 and 28; and guide means 27, these will be more fully described hereinafter.

Paper package-sterilizing, liquid-charging and top-sealing section 30 comprises a conveyor for transfer of package stocks 1, bottom flaps of each of the bottom portion which have already been assembled together, successively in their elected state, in an intermittent mode. The section 30 further comprises a primary package top folder 32; a sterilizer agent sprayer 33; driers 34; a cooler 35; a liquid charger 37 fitted with a charging nozzle 38; a secondary package top folder 39; a heater 40; and a package top folding and pressurizing unit 41 at a certain higher level than the conveyor 31 and substantially in succession one after another as shown. The sterilizer dispenser 33 applies a sterilizer liquid in form of sprays, consisting preferably of an aqua-solution of hydrogen peroxide or the like over the whole inside wall surface of each semiassembled package 1, which will be referred to as "semipackage" hereinafter, thereby all the inside surfaces of the semipackages, as well as the inside surface of each spout 2 being subjected to an optimum sanitary treatment.

It should be noted that both of the foregoing sections 20 and 30 are mounted within the interior space of a sterilized chamber 42.

The foregoing spout-attaching unit will be described more specifically with reference substantially to FIGS. 3 and 4.

Numeral 51 represents a horizontally elongated turret rotatable about an axis X—X, which comprises a rotatable shaft 52; a main body portion 53 fixedly mounted on the latter; and four holder units 54 for holding respective package stocks, said units being arranged at equidistant from one after another about the axis X—X. Each set of these holders 54 is so designed and arranged to hold a package stock 1 by contacting a pair of diagonal corners thereof from outside, as may be most clearly understood from FIG. 3, for the purpose of holding the semipackage in parallel to the central axis X—X. Thus, by moving the semipackage in parallel to the central axis to-and-fro, it is possible to introduce into or reversely to discharge from the package holder. In addition, it is also possible to shift the semipackage, while being held by the package holder 54, in parallel to the central axis.

The rotational central shaft 52 is fixedly attached with a gear 55, a turret driver, not shown, being kept in engagement therewith. This driver is designed and arranged in such a way that the semipackages held by the turret 51 are successively and intermittently positioned at provisionary holding stations S3, S4; S5 and S6, respectively. The first station S3 serves to introduce or discharge the semipackage into or from the package holder 54, respectively. The third station S5 serves for introducing the spout 2 into the interior space of semipackage 1 under consideration. Th fourth station S6 serves for fusingly attaching the flange portion 3 of each introduced spout 2 onto one of the top end laps of the semipackage, thus being called briefly "spout-seal-on-station" hereinafter, when necessary.

Figure 5:
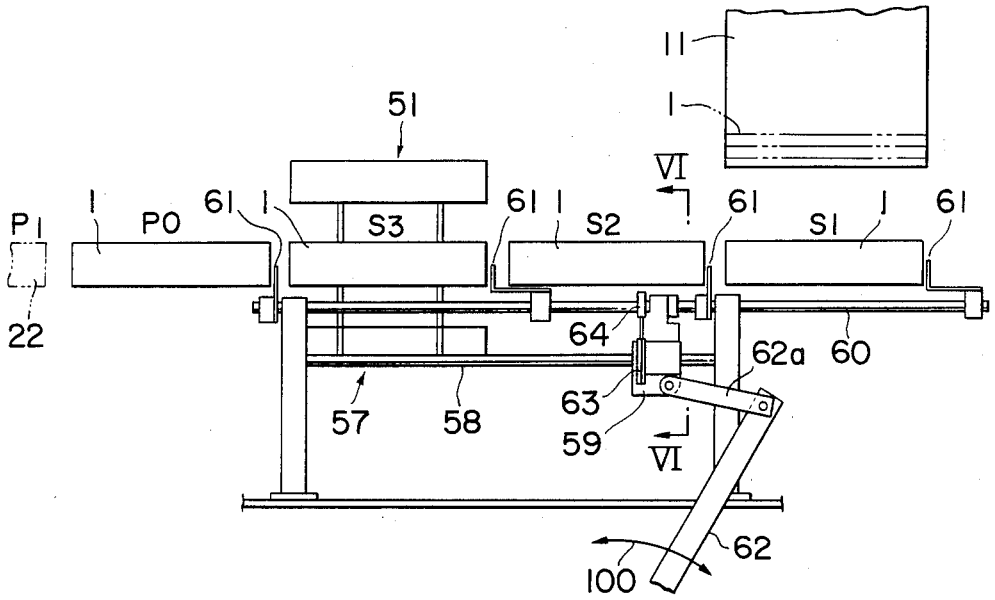
FIG. 5 is a schematic side elevation of a semipackage introduction unit.
Figure 6:
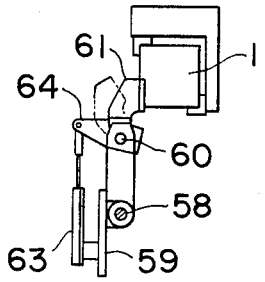
FIG. 6 is a detailed end view of a semipackage pusher employed in the arrangement shown in FIG. 5.

In FIG. 5, representing a side elevation of a semipackage, introduce and discharge unit 57 is adapted for introducing and discharge treatment of the semipackage into and from the package holder when the semipackage is held provisionally at the first station S3. In this FIG. stations S1; S2; S3 and P0 represent those for provisionally holding respective semipackages 1. Although not shown, there is provided a holder at each of these stations for holding the semipackage in an axially movable attitude. Further, as seen from FIG. 5, all the semipackages held at these stations are arranged not only in a straight line one after another, but also in straight line registration with the horizontal mandrel 22 of the bottom portion assembling unit 20. In other words, turret 51 is arranged midway in the axially carrying route for the semipackage 1 under the action of the package holder at the station S3 to shift the semipackage from station S1 to mandrel 22. The unit 57 comprises a guide bar 58 arranged in parallel to the linear arrangement of semipackages 1; a slider 59 slidably mounted thereon; a rod 60 movable horizontally in unison with slider 59; four pressure applicators 61 fixedly mounted on the movable rod 60; and a pivotable lever 62 linked through a link member **62*a* with slider 59 for reciprocatingly driving the latter on and along guide bar 58. The pivotal movement of lever 62 is hinted by a double head arrow 100 shown. With leftward sliding movement of slider 69 in FIG. 5, pressure applicators 61 will push respective semipackages 1 from behind leftwards by a predetermined one step or pitch length. As may be well adjudged from joint observation of FIGS. 5 and 6, slider 59 is fitted with a pressure air cylinder 63 which, when energized, operates to provide a partial rotational movement of the movable rod 60 through the intermediary of a small lever 64 for receding the pressure applicators 61 off from contact with respective semipackages 1**.

Figure 4:
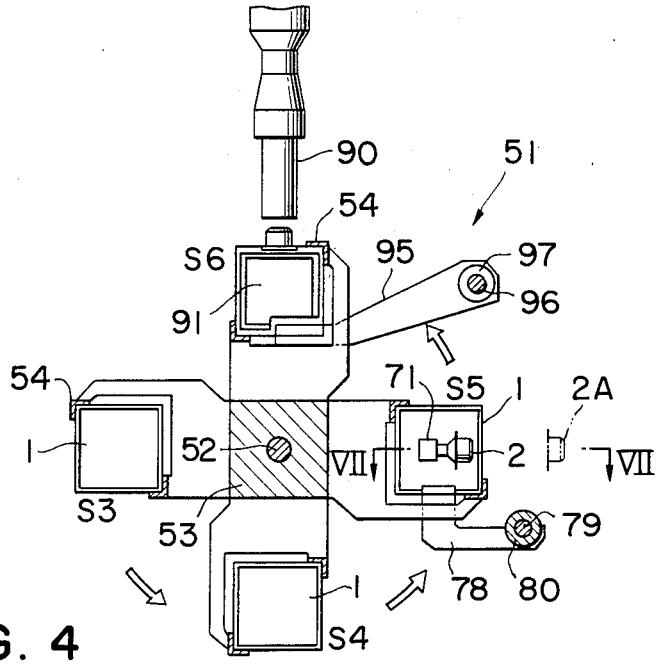
FIG. 4 is a sectional view taken along a section line IV—IV shown in FIG. 3.
Figure 7:
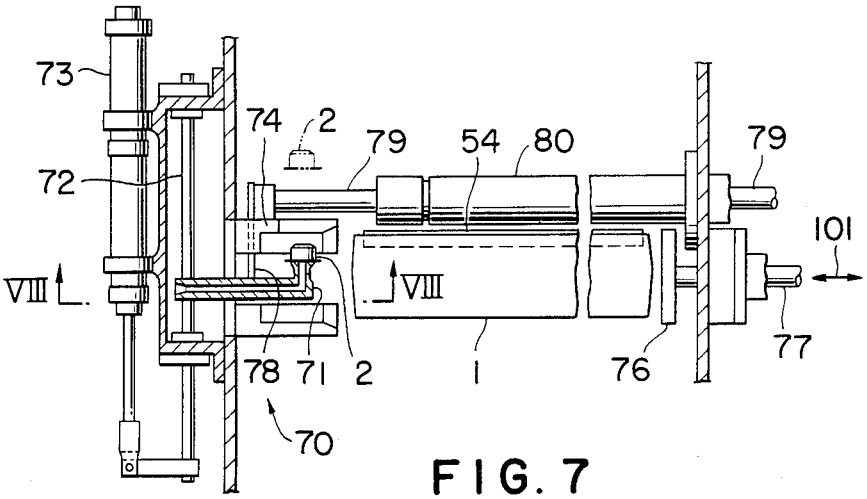
FIG. 7 is a sectional view taken along a section line VII—VII shown in FIG. 4.
Figure 8:
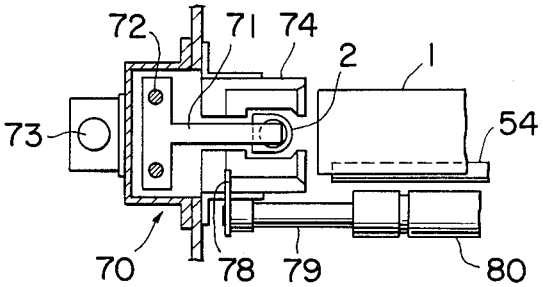
FIG. 8 is a sectional view taken along a section line VIII—VIII shown in FIG. 7.

FIG. 7 represents a sectional view taken along a section line VII—VII shown in FIG. 4 of the spout-attaching unit 51, while FIG. 8 represents a sectional view taken along a section line VIII—VIII shown in FIG. 7.

Numeral 70 represents a spout-insertion unit mounted at a position in horizontal alignment with the specific semipackage 1 held by package holder 54 provisionally stopped at S5 and comprising a sucker 71 for holding suckingly a spout 2; a cross bar 72 movable in the transversal direction relative to the axial line of the semipackage 1 and mounting the sucker; a two-stage cylinder unit 73 which positions sucker 71 at two differrent operating positions through the intermediary of the cross bar 72 and guide means 74 for properly guiding the rectangular corners of the leading end of each semipackage 1 under consideration.

Figure 9:
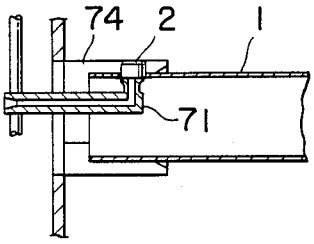
FIG. 9 is a detailed sectional view showing the operational relation among a sucker, a spout and a semipackage.

Two-stage cylinder 73 operating upon the sucker 71 is so designed and arranged to position the sucker at three different positions: viz. a ready-for-operation position shown in full line in FIG. 7; a spout-receiving position for receiving a spout 2A held at a ready position, only schematically shown in chain-dotted line in FIG. 7, upon delivery thereto through delivery chute 14 shown in FIG. 2; and a spout-inserting position for introducing a spout 2 within the hollow interior space of a semipackage 1 under consideration and shown in FIG. 9.

In FIG. 7, numeral 76 represents a pusher positioned in close proximity to the tail or bottom end of a semipackage 1 under consideration, while numeral 77 represents a carrier rod which mounts the pusher 76. As hinted by a double head arrow 101, carrier rod 77 performs a reciprocating motion under the acting drive means, not shown. All these related members constitute a semipackage forwarding mechanism. Numeral 78 represents a further pusher arranged in proximity of the forward end of the semipackage 1 under consideration. 79 represents a driver rod mounting the pusher 78. 80 represents a stationary guide sleeve for slidably holding the driver rod 79. As shown in FIG. 3, the operating end of a crank lever 81 pivotable about a support pin 82 as a center, is linked with drive bar 79 at the rear end thereof. The opposite or motion receiving end of crank lever 81 carries a follower 83 cooperating under pressure with a disc cam 85 fixedly mounted on a rotatable drive shaft 84, as shown in FIG. 3. With rotation of cam 85, thus, crank lever 81 will perform a preciprocating pivotal movement, thereby to drive shaft 79 and pusher 78 being subjected to a reciprocating movement. The pusher 78 is formed with a part which is capable of contacting the lower wall of the semipackage 1, under consideration as may be most clearly understood from FIG. 4. With rightward shift of pusher 78, the semipackage 1 will perform, therefore, a receding motion in the righthand direction, when seen in FIGS. 7 and 8. Therefore, pusher 78, drive shaft 79 and their related drive means constitute in combination, thus, a semipackage-receding unit.

Next, spout supply unit 13 for feeding the spouts piecewise to a position adapted for transfer the latter to the sucker 71 will be described in detail.

Figure 14:
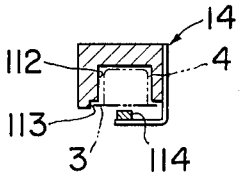
FIG. 14 is a cross-sectional view taken along a section line XIV—XIV shown in FIG. 11.
Figure 13:
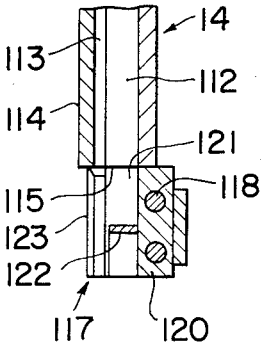
FIG. 13 is a detailed sectional view taken along a section line XIII—XIII shown in FIG. 11.

The chute 14 already shown in FIG. 2 is formed with a channel-sectioned guide groove 112 adapted for receiving the cylindrical spout proper 4, shown only by its outline configuration, of each spout unit 2; a guide surface 113 adapted for guidance of crosswise extending straight line edge **5*a* of the flange portion 3 of the unit 2, if necessary, reference may be made to FIG. 41, and a drop-preventing means or holder 114 extending longitudinally of the chute and effective only at a small distance from the guide groove 112, as shown in the cross-section of the chute in FIG. 14. At least the lower end portion of chute 14 is arranged vertically, as shown in FIG. 13**.

Figure 15:
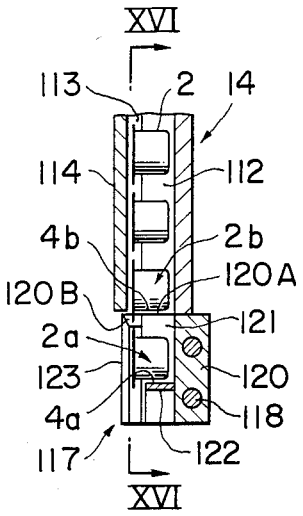
FIG. 15 is a detailed vertical section of the lower end of the spout-supply chute and its several related parts.
Figure 16:
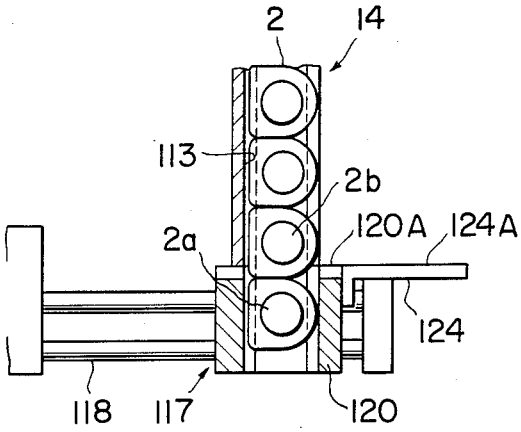
FIG. 16 is a detailed sectional view taken along a section line XVI—XVI shown in FIG. 15.
Figure 17:
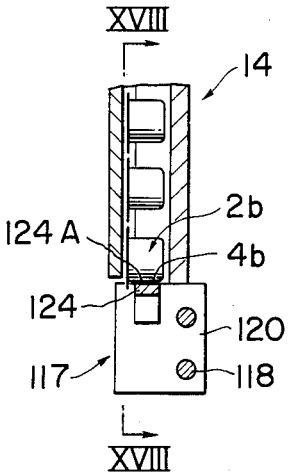
FIG. 17 is a similar view to FIG. 15, yet showing a different operating condition.

Specifically as shown in FIGS. 15 and 16, a large number of spouts 2 arranged in a mutually contacting series by their respective flange portions are slidably mounted in the elongated chute 14 under gravity action. Thus, when the lowermost spout has been taken out, all the remaining upper spouts can automatically slide down. At the upper end of chute 14, an automatic feeder 13 is connected for replenishing of spouts therefrom, as shown in FIG. 2 by way of example. A feed-out or outlet opening 115 is formed at the lower end of chute 14, as specifically shown in FIGS. 11 and 13.

In close proximity of the lower end of chute 14, there are provided a slider 117; a pair of parallel guide shafts 118 adapted for allowing transversal movement of slider 117 relative to chute 14; and a pressure air cylinder 119 for driving the slider 117 in a reciprocating manner. The slider comprises a main body portion 120 formed with a spout-reception space 121 adapted for receiving the lowermost of the spouts 2; a stopper 122 adjustable in the position and adapted for supporting the cylindrical portion of the spout introduced into the spout-reception space 121; a front plate portion 123 adapted for support of a part of spout flange portion (refer to FIG. 12); and an elongated, laterally extending projection 124, having an upper surface 124A extending in registration with the upper surface 120A of main body portion 120. Although not shown, the upper end of spout-reception space 121 is formed with a tapered portion or portions for assuring an easy and smooth piecewise introduction of a spout from the outlet opening of chute 14, although not shown.

As shown in FIGS. 15 and 16, when stopper 122 mounts the cylindrical spout proper **4*a* of a spout 2*a*, an attribute "a" or "b" being attached specifically for the purpose of clearer understanding at this stage of description, the lower end of similar spout proper 2*b* arranged directly above the foregoing spout 2*a* is kept substantially in registration with the upper surface 120A of main portion of a slider 127 and with the upper surface 124A of projection 124. Thus, even if the slider 117 has been shifted by a small horizontal distance to the position shown in FIG. 18, the lowermost spout 2*b* positioned at this stage is supported by the upper surface 120A of slider main body 120 as well as upper surface 124A of projection 124, thus being positively prevented from dropping out of the chute 14. These surfaces 120A and 124A serve in combination, thus, as stopper means for the prevention of drop-out of spout(s) from the delivery opening 115 of the chute 14. Additionally, main body 120 of slider 117 is formed at the upper surface thereof with a slit 120B for avoiding otherwise possible interference with the flange portion of spout 2*b* held in the chute 14 during horizontal movement of slider 117**.

Figure 11:
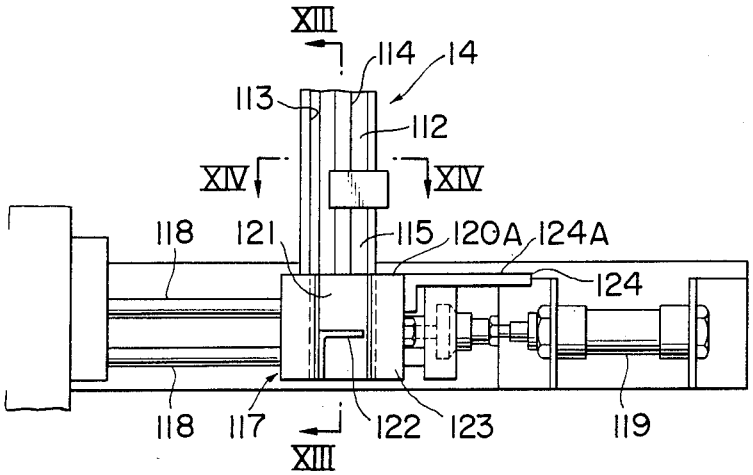
FIG. 11 is an elevational view of the lower end portion of a spout-supply chute and several cooperating parts arranged in close proximity thereof.
Figure 12:
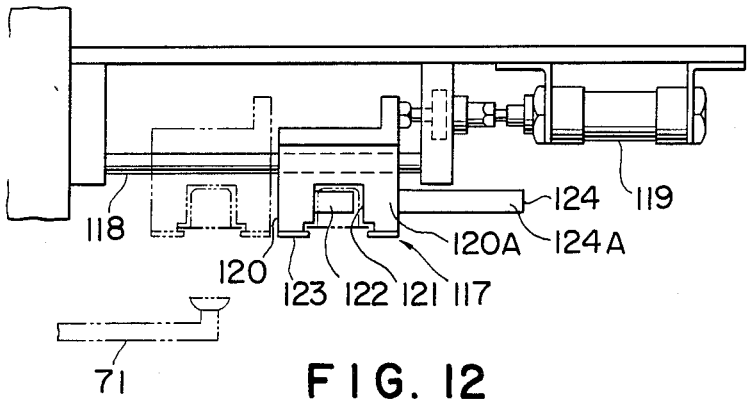
FIG. 12 is a schematic plan view thereof.

Pressure air cylinder 119 constitutes a slider drive unit for driving the slider 117 between a first, spout-reception position where the containing space 121 thereof kept in alignment with the spout feed-out opening 115 of chute 14 as shown in FIGS. 11 and 12 in full lines and a second, spout carry-out position off-set from said first position as shown in FIG. 12 in chain-dotted lines.

Next, the spout-supplying function of the previously described unit will be set forth hereinbelow more specifically.

Figure 18:
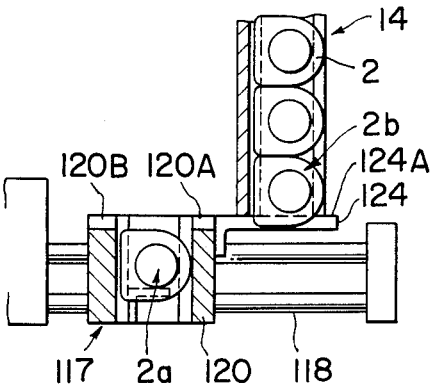
FIG. 18 is a sectional view taken along a section line XVIII—XVIII shown in FIG. 17.

First, it is assumed that the containing space 121 of slider 117 is kept in alignment with the lower end of chute 14, as shown in FIGS. 14 and 15. Under these conditions, a series of spouts are mounted in or on the chute and kept in mutually contacting and overlapping state by their flange portions, including the lowermost one positioned in the containing space 121, as was referred to hereinabove. Next, air cylinder 119 is actuated in shift the spout-charged slider 117 towrds left in FIGS. 11 and 16. By this shift movement, the spout **2*a* carried therein is positioned off from the now lowermostly positioned spout 2*b* in the chute, and carried to the take-out position, as shown in FIG. 18, as was referred to above. During this shift movement of the slide, the last remaining spout 2*b* in the chute 14 is mounted jointly on the stopper surfaces 120A and 124A, thus being positively prevented from dropping-out. With arrival of slider 117 at the spout-take-out position, sucker 71 is advancingly shifted in FIG. 12 to the neighboring position to the spout 2*b* which is therefore sucked by the sucker and then the latter will go back to the normal position, thereby the spout being taken away downwards in FIG. 12. At this operation stage, only one spout is held in the slider 117 and kept separated from the remaining spout series in the chute. Therefore, the present spout takeout operation can be carried out in a positive and reliable manner, while the remaining spout series in the chute is not ill-affected by the suckingly take out operation to any detrimental degree. It will be seen that part of the flange portion of the spout held in the slider 117 is bound by contact with the front plate 123 during the foregoing suck-out stage. However, the flange portion is flexible so that it can be sucked out forcibly upon deflection and with a small amount of resistance. Upon taking-out operation for the spout under consideration, the slider 117 will be brought back into the starting position for new spout reception, shown in FIGS. 15 and 16**. In this position, the next spout in the chute will shift under gravity to the lowermost position and brought into the sider as before, and so on. In this way, the spouts contained in the chute will be successively and piecewise shifted to the takeout position to be subjected to a sucking takeout operation.

Figure 3:
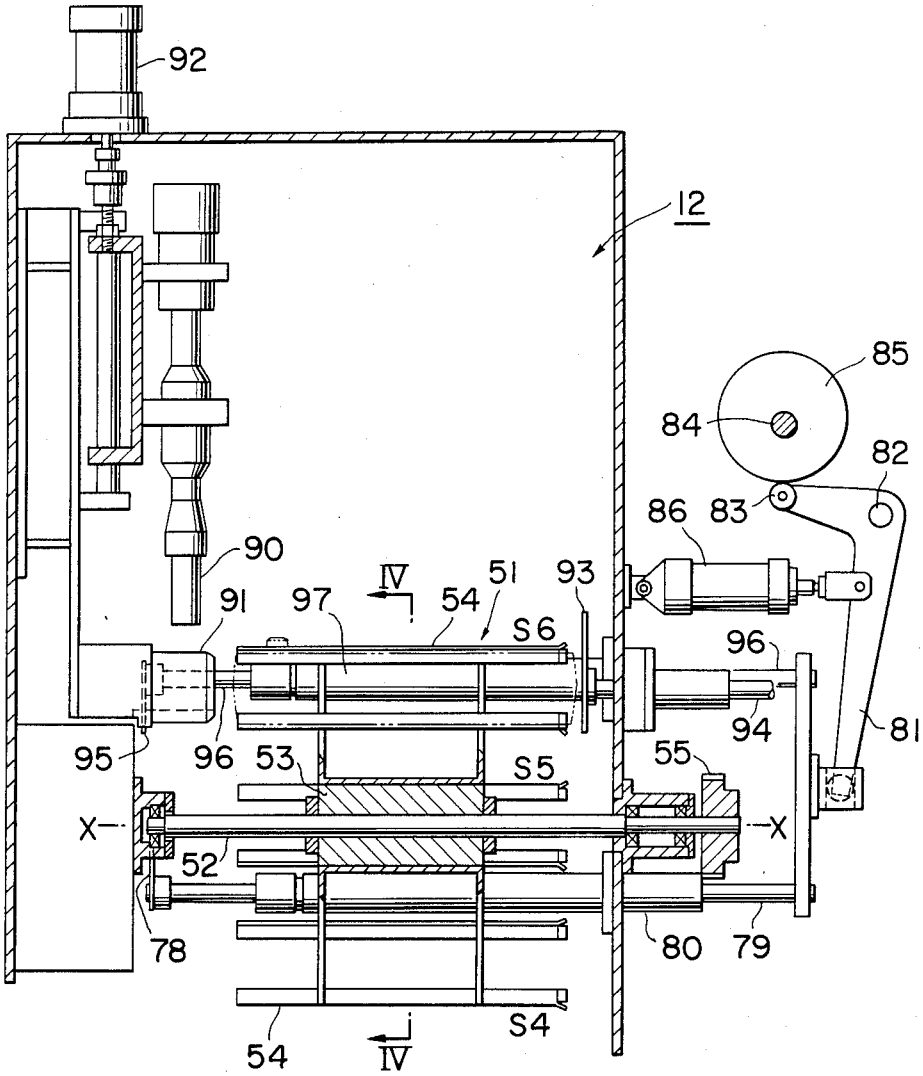
FIG. 3 is an enlarged cross-sectional view of a spout-taking out unit employed.

In FIG. 3, numeral 90 represents an ultrasonic wave horn consisting of part of the spout-sealing unit arranged in proximity of the extension line of the semipackage held by the package holder 54 when the held semipackage is halted at the spout-sealing position. 91 represents an anvil for supporting the semipackage under consideration by its inside wall surface. The horn 90 is arranged up-and-down movably in FIG. 3 under the action of air-cylinder 92. 93 represents a presser arranged in proximity of the righthand end of the held semipackage. 94 represents a horizontally extending driving bar mounting the presser 93. Driving bar 94 is mechanically connected with a drive means, not shown, which was referred to hereinbefore as means for driving the drive bar 77 to perform a reciprocating movement. Therefore, driving bars 94 and 77 perform respective reciprocating motions in synchronism with each other. Thus, these elements constitute in combination a package advancing mechanism capable for pressure-forwarding the semipackage under consideration and leftwards in FIG. 3.

Numeral 95 represents a further presser which is arranged in proximity of the lefthand end of the semipackage under consideration. 96 represents a driving bar holding the presser 95. Numeral 97 represents a sleeve which slidably mounts the driving bar 96. Pivotable lever 81 is connected with the rear end of driving bar 96, in the similar way as in the case of drive bar 79, thus the latter being capable of performing a reciprocating movement in synchronism with the foregoing drive bar 79.

As is clearly understood from FIG. 4, presser 95 is formed with a part which is engageable with the bottom surface of the semipackage under consideration. With rightward shifting movement of the presser 95 when seeing in FIG. 3, the semipackage recedes towards left in synchronism therewith. It may be understood, therefore, presser 95, driving bar 96 and driver mechanism therefor constitute in combination a package-receding mechanism.

Figure 19:
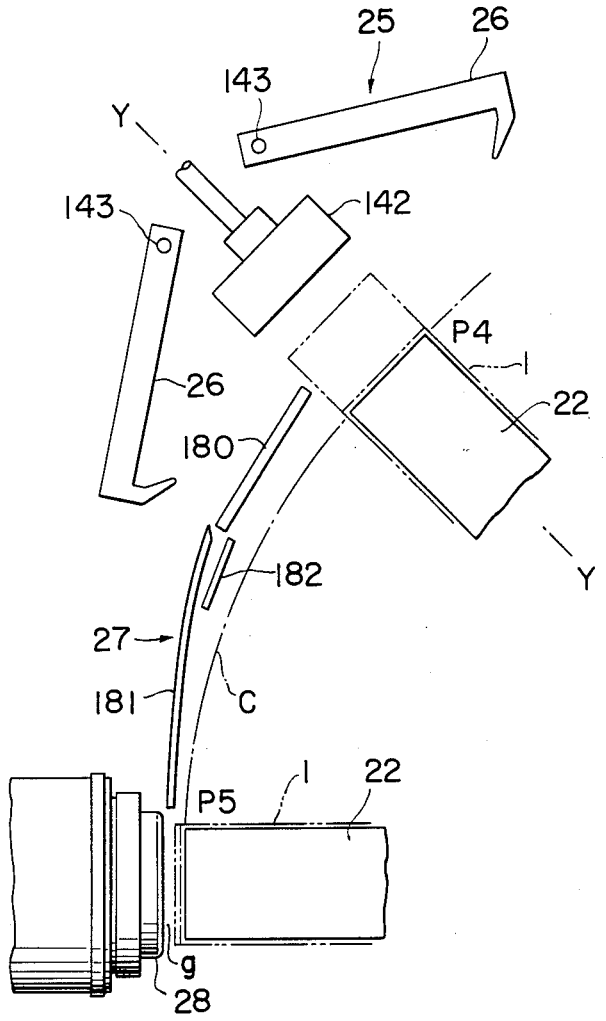
FIG. 19 is a schematic and enlarged elevational view, showing the operations of a mandrel arm.

As shown in FIG. 19, the package-bottom fold-on mechanism 25 comprises a folding guide 142 in addition to the foregoing pair of folder arms 26 which are held fixedly on a pair of shafts 143 arranged in parallel with the rotational axis of turret 21.

Figure 23:
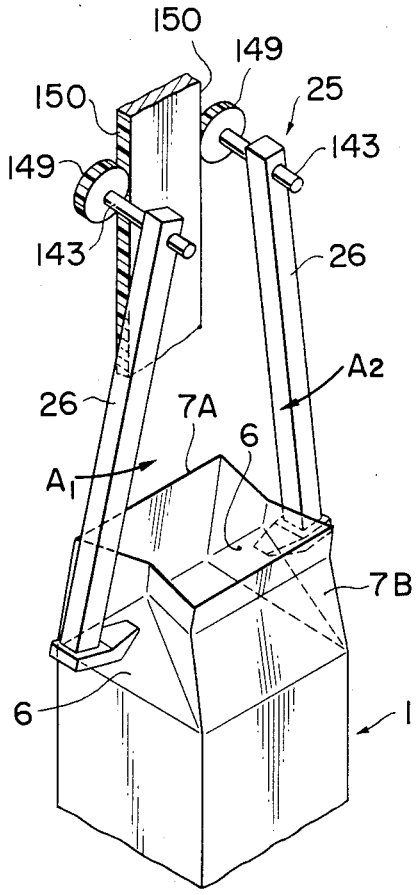
FIG. 23 is a schematic perspective view, illustrating the folding-in operation of a pair of pivotable folding arms.

With opposite and synchronized rotations of these shafts 143, the arms 26 can perform respectively a large pivotal movement in a plane perpendicular to the central rotational axis of turret 21, as well as parallel to the rotary plane of mandrels 22 and more specifically substantially in symmetry relative to the central axis Y—Y of the latter. These fold-in or -on arms 26 perform a large arcuate pivotal movement, as shown in FIG. 23 by a pair of small arrows A1 and A2, for folding triangular panels 6 into position. The folding guide 142 is arranged to move along central axis Y—Y of the mandrel and formed with a pair of inclined operating surfaces 145 and 145' adapted for acting upon the respective tip ends *7a* and *7b* of bottom flaps 7A and 7B, and an inclined slit 146 is formed therebetween, as shown specifically in FIGS. 24 and 25.

Figure 24:
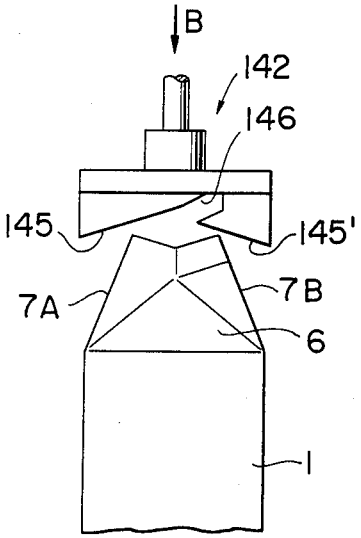
FIGS. 24 and 25 are schematic explanatory views of the pressure-applying shaping mode for forming the semipackage bottom portion.
Figure 25:
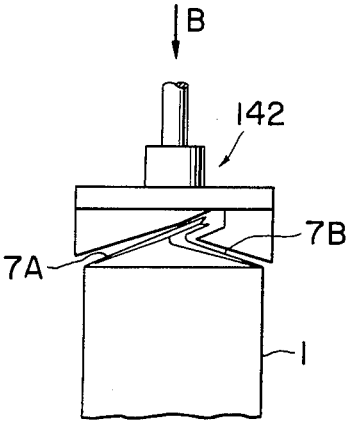

When the folding guide 142 is moved in the direction shown by a small arrow B from the position illustrated in FIG. 24 until it is brought into pressure contact with the top-and-bottom inverted bottom end of the semipackage 1, the bottom flaps 6A and 6B are folded-in and -on into position as illustrated in FIG. 25.

Figure 26:
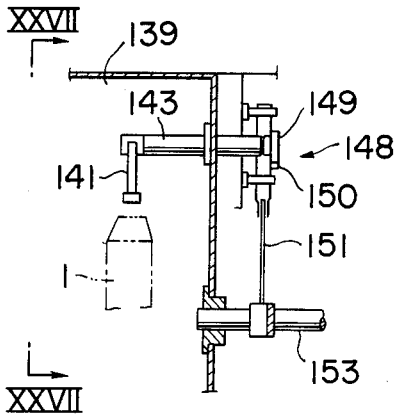
FIGS. 26, 27 and 28 are schematic explanatory views, illustrating a modified drive mechanism for driving a pair of pivotable fold-in arms.
Figure 27:
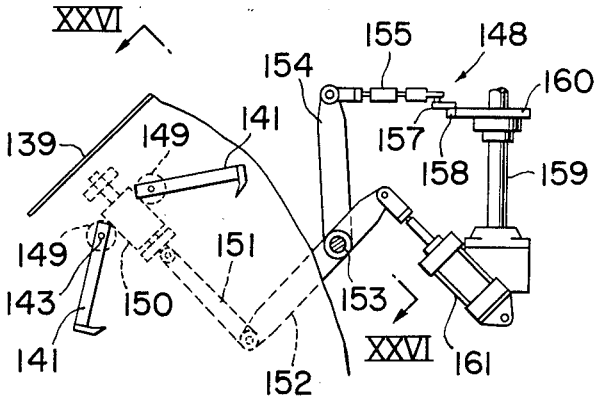
Figure 28:
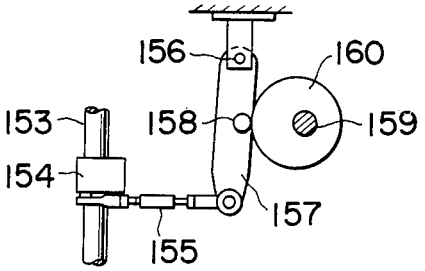

To fold-on arms 26 and folding guide 142 are connected respective and separate drive means. In FIGS. 26 through 28, a first drive means 148 adapted for allowing pivotal reciprocating movements of fold-on arms 26 is shown. It should be noted that in these drawings, the folding guide and its related drive means have been omitted for purposes of simplifying the drawings. The first drive means 148 comprises a pair of gears 149 fixedly mounted respectively on the shafts 143 and kept in meshing with movable rack means 150 from both sides thereof; a lever 151 mechanically connected with the rack means 150; a crank lever 152 linked with the lever 151; an intermediate shaft 153 mounting said crank lever 152; a link lever 154 fixed to the intermediate shaft 153; a connecting rod 155; a pivotable lever 157 connected with connecting rod 155 and pivotable about a supporting shaft 156 as a center; a cam follower 158 fixed on lever 157; a drive shaft 159; a cam 160 fixedly mounted on drive shaft 159; and a pressure air cylinder 161 urging under pressure the cam follower 158 against the cam 160. With rotary movement of cam 160, the rack means 150 will thus perform a reciprocating movement, whereby the fold-on arm pair 26 is reciprocatingly rotated in synchronism therewith. The range of angularly reciprocating movement of the arm pair 26 extends between then most receded position shown in FIG. 19 so as to assure the bottom of the semipackage 1 mounted on mandrel 22 to perform its free and thus trouble-free movement and the ready-position for performing a positive triangular-panel fold-in job, as shown in FIG. 23.

As a modification, the rack means 150 may be dispensed with and the pair of gears 143 are arranged to mesh with each other. In this case, one of these gears is arranged to swivel in synchronism with the rotation of cam 160, the pair of hooked levers 26 being swivelingly reciprocated.

As still another modification, a grooved cam may be employed and the air cylinder may be dispensed with, and, instead of the foregoing pressure contact of cam follower 158 with cam 160 with use of the air cylinder 161 in the foregoing.

As a still further modification of the drive power source provided with the cam, an air cylinder can be used.

Figure 29:
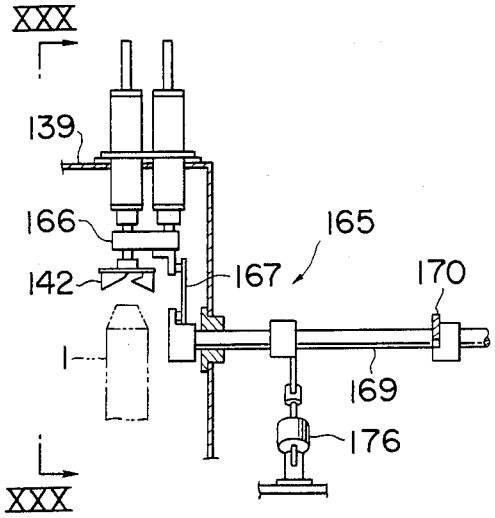
FIGS. 29, 30 and 31 are several schematic explanatory views, illustrating the operations of a driver for linearly shifting a folding guide.
Figure 30:
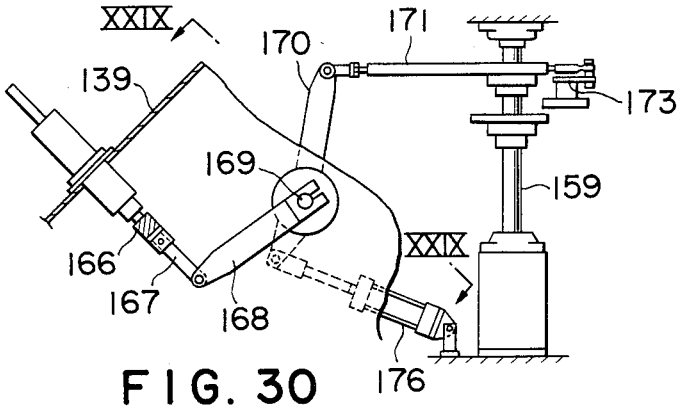
Figure 31:
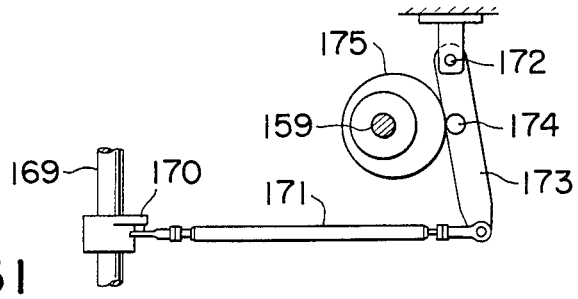

In FIGS. 29 through 31, the second drive means 165 for execution of linear shifting movement of folding guide 142 will be illustrated. It should be mentioned, however, that the folding-in pawls or levers 26 and the already described first drive means have been omitted from these drawings to avoid excess crowding thereof.

This second drive means 165 comprises a block 166 for holding the folding guide 142; a lever 167 connected with the block; a further lever or link 168 connected with the lever 167; an intermediate shaft 169 holding said lever 168; a still further lever 170 fixedly mounted on shaft 169; a connecting rod 171; a link 173 connected with rod 171 and pivotable on support pin 172 as a center; a cam follower 174 fixedly mounted on link 173; a drive shaft 159; a cam 175 fixedly mounted on shaft 159; and a pressure air cylinder 176 acting upon cam follower 174 so as to hold the latter in pressure contact with cam 175. It will be seen, therefore, that with rotary movement of cam 175, folding guide 142 will execute a reciprocating movement. The drive shaft 159 is so designed and arranged to commonly serve as drive shaft for the foregoing first drive means 148. In addition, the drive shaft 159 is arranged to rotate in synchronism with the intermittent rotary means driving the turret 21. For this purpose, folding-in pawl 141 and folding guide 142 will operate as will be later more fully described, in synchronism with the intermittent rotary movement of the turret.

In the present second drive means 165, a grooved cam may be used in place of the face cam shown, for dispensing with the air cylinder. As a further alteration, air cylinder means can be employed in place of cam means.

Figure 20:
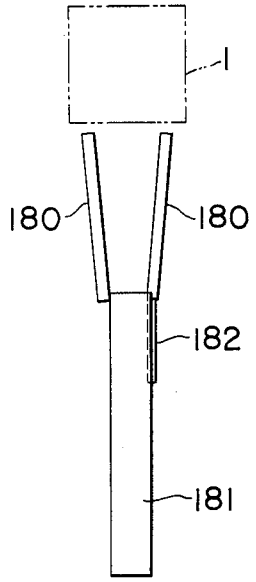
FIG. 20 is an enlarged schematic view of guide means appearing in FIG. 19.
Figure 21:
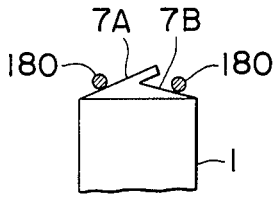
FIGS. 21 and 22 are detailed schematic views, partly sectioned, showing schematically semipackage bottom the binding action for portion.
Figure 22:
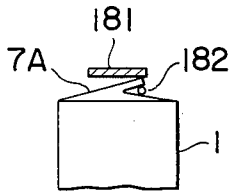

In FIG. 19, guide means 27 consists of a first guide 180 and a second and next succeeding guide 181. As seen from FIGS. 20 and 21, the first guide 180 consists of a pair of bars which are in contact with inclined surfaces of bottom flaps 7A and 7B of the semipackage 1 while being conveyed thereof as mounted on the mandrel for the purpose of preventing otherwise possible spring back movement of these flaps. This first guide 180 represents rather smaller effective lateral range or width when seen in the shifting direction of the semipackage under consideration. With progress of shifting of the semipackage, it is applied pressure at rather more central portion of the combined bottom flaps 7A; 7B. With such arrangement and function of these related elements, these bottom flaps become rather compact and concentrated together towards final bottom structure as the semipackage under consideration is shifted further and further.

There is provided the second guide 181 at a downstream position from the first guide. This second guide 181 serves for applying pressure upon the bottom flap ends for binding of the latter together against spring back thereof. As may be well understood from FIG. 19, the gap distance between the shifting locus C of the tip end of the mandrel and the second guide 181 changes as the semipackage under consideration proceeds to shift. Thanks to this structure and arrangement of these related parts, the bottom flaps 7A; 7B will become rather more compact and even at the position P5, and the bottom of the semipackage will not collide against the package bottom folding and pressurizing mechanism 28 which is positioned only at a small distance from the tip end of mandrel 22, as the semipackage proceeds to shift. Additionally, it should be noted that an auxiliary guide bar 183 is provided in close proximity of the junction point between the first and second guides 180; 181, for execution of better guidance of folded end portion of the bottom flap 7B.

At this stage of description, the general function of the above described apparatus will be set forth.

Now, turning back to FIG. 1, a large number of package stocks equally denoted with common reference numeral 1 only for convenience and each taking the form of a collapsed cylindrical, overlapped double-sheet paper board stock, are preliminary stored one after another into a vertical stack, within the feeder 11 provided in the package stock supply unit 10. Then, these stocks 1 are taken out by means of a conventional conveyor means, not shown, piecewise one after another from the feeder 11 and conventionally expanded into hollow square cylindrical envelopes and carried to the first station S1.

Further, these stocks 1 are intermittently conveyed by means of the package introducing and discharge unit 57, shown in FIG. 5, through stations S2 and S3, and to the package holder 54 of turret 51. It is to be noted that turret 51 is kept provisionally stationary during the carrying movement of each package stock.

Figure 32:
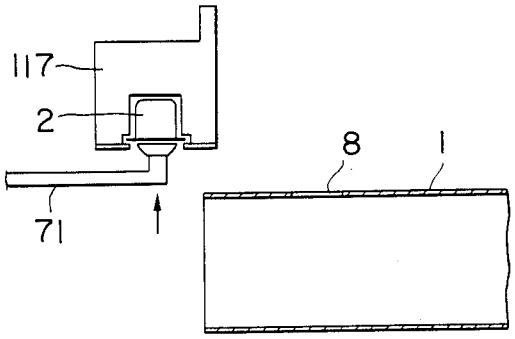
FIGS. 32, 33 and 34 are schematic and partially sectional views, for illustrating substantially three operational steps of the sucker for sucking, draw-out and introducing a spout into position.
Figure 33:
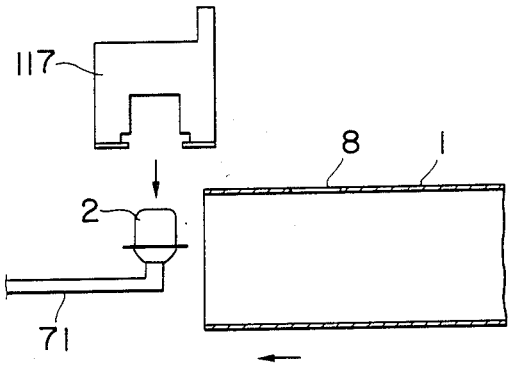

Next, with intermittent rotary movement of the turret 51, the semipackage under cnsideration will be forwarded further through stations S4 and S5. Until arrival of the semipackage at the station S5, the sucker 71 is advanced towards a spout 2, as shown in FIG. 32, prefed through chute 14 and slider 117 (refer to FIG. 18), and, now carrying the spout under consideration, is held at its receded and ready-for position, as shown in FIGS. 7 and 33.

Figure 34:
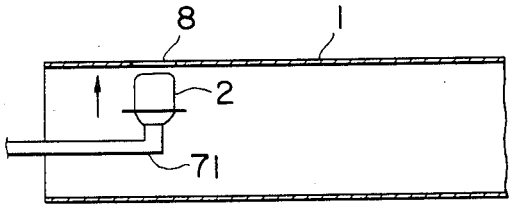

Under these operating conditions, when the semipackage, shown equally with common numeral 1, is conveyed to station S5 and halted thereat, presser 76 is advanced leftwards in FIG. 7 under the action of drive bar 77, thereby the semipackage under consideration being forwarded likewise in the leftward direction, until the periphery of the forward end thereof is introduced into guide member 74, so as to bring about the state shown in FIG. 34.

Then, sucker 71 is driven to advance in the lateral direction relative to the central axis of the semipackage, thereby the hold spout 2 being introduced from inside into a reception opening 8 formed through the wall of the semipackage (See FIG. 9). Then, the sucker 71 is released from the spout-holding service position and returns to the original ready-for-service position. At the same time, the pusher 78 arranged at the front end side of the semipackage under consideration will move in the rightward direction in FIG. 7, so as to return the semipackage to the original position.

Figure 10:
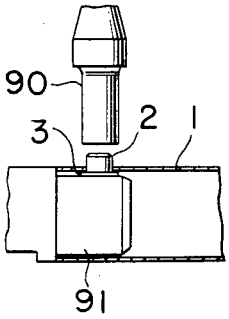
FIG. 10 is a detailed sectional view showing several operating parts.

Then, the semipackage 1 is transferred from station S5 to S6 by a partial rotational movement of turret 51 and halted thereat. At station S6 in FIG. 3, first, presser 93 will advance leftwards, so as to forward the semipackage 1 correspondingly, thereby the front end of the latter being capped on the anvil 91. In this position, the flange portion 3 of spout 2 is mounted on anvil 91, as illustrated in FIG. 10.

Next, ultrasonic wave horn 90 will descend under the action of air cylinder 92, until the horn tip end is brought into pressure contact with the outlet surface of semipackage 1 under consideration, thereby ultrasonic vibrations being applied thereto. By this ultrasonic transmission, the heat-sealable coating layer applied beforehand onto the inside wall surface of the semipackage and the spout-flange 3 made of a properly selected thermo-fusible resin are thermally and fusingly united with each other, for attaining a satisfactorily thermo-fused structure around the spout element or unit 2.

Upon completion of the fushingly jointing job between the spout element and the semipackage proper, the horn 90 will be elevated to its original off-service position, whereupon the presser 95 arranged at the left hand side of semipackage 1 shown in FIG. 3 is shifted rightwards under the action of drive shaft 96 for drawing out the semipackage from engagement with anvil 91, so as to recede it to the original position.

Then, the semipackage 1 fusingly fitted with a spout 2 is shifted by the intermittent rotation of turret 51, to the former station S3, and, during holding thereat, the semipackage will be horizontally carried to a new station P0 under the action of the package-introducing and discharge unit 57 shown schematically in FIG. 5. It is to be noted that simultaneously with discharge of the semipackage 1 under consideration, a new semipackage designated with same reference numeral 1 as before only for convenience, is conveyed from station S2 into the semipackage holder at station S3. On the other hand, the foregoing semipackage held at station P0 is conveyed and capped on the mandrel 22 kept at a horizontal preparation position and included in the package bottom assembling unit 20 contained in the sterilized chamber 42 shown in FIG. 1. At this stage, the semipackage 1 is so positioned that the bottom fold-on surface directs in the perpendicular direction relative to the rotational axis of mandrel 22 and more specifically further that the spout-attaching surface at the package head portion or in other words such surface through which the spout-insertion opening 8 has been bored is kept in parallel with the rotational plane of mandrel 22, and the semipackage is capped onto the latter, while taking the presently set forth special attitude.

With stepwise rotation of turret 21, the semipackage capped on the mandrel 22 will be rotatingly shifted from station P1 through P2–P7. At stations P2 and P3, the thermo-fusible and heat-sealable coating layers already applied onto the front and rear wall surfaces at the package bottom portion are brought together into fusion under the action of heaters 33; 34 shown in FIG. 1. At station P4, the folding arms 26; 26 push the triangular panels 6; 6 positioned front and rear, respectively, of the semipackage 1 under consideration, relative to the shifting direction of mandrel 22, together inwards, as shown in FIG. 23. Then, the folding guide 142 is moved towards mandrel 22 for folding-in of bottom flaps 7A; 7B, as most clearly seen from FIGS. 24 and 25.

It should be noted that during the above shifting movement of folding guide 142 in the above mentioned manner, the folding-in arms 26 will be receded for avoiding the occurrence of interference with the folding guide 142. Upon completion of the shifting movement of folding guide 142 to its final operating position shown in FIG. 25, a new semipackage will be fed to station P4, as shown in FIG. 19, while the bottom-folded-in semipackage will be forwarded to the next succeeding station P5.

Next, the thus bottom-folded-in semipackage 1 is transferred from position P4 to P5 by the corresponding shift movement of mandrel 22. Since the slit 146 on folding guide 142 extends substantially in the shifting direction of semipackage, the tip ends of bottom flaps 7A; 7B will be disengaged from the slit 146 during the shifting movement of mandrel 22. In order to easily perform said disengagement of bottom flap tip ends from slit 146, the folding guide 142 is shifted only a small distance in the receding direction from the mandrel, and indeed, in synchronism with the shifting movement of the latter. This shifting movement of the folding guide is easily brought about under the action of cam 175.

As may be well seen from FIGS. 19 through 22, package bottom folded in position in the foregoing manner under the action of folding guide 142 is subjected to a provisional binding action by the first guide 180 and in advance of complete separation of the package bottom from the guide 142, thereby the folded-in shape of the package bottom being positively prevented from its spring-back movement towards its original state before folding. As being slidingly guided by contact with first guide 180 and therealong, the package bottom is further folded in more and more compact state under pressure. With further contacting and sliding with and along second guide 81, the package bottom is further compacted into a substantially flat shape. The semipackage will be forwarded to station P5 in this flattened state, so as to allow its bottom to be introduced into a small gap space "g", shown in FIG. 19, formed between the tip end of mandrel 22 and the operating end of package bottom folding and pressurizing unit 28, and indeed, without any hindrance. Then, the unit 28 is advanced for establishing a pressure-contact of the package bottom against operating end of mandrel 22, resulting in the desired pressurized and fused-together formation of the package bottom. At this stage, assembly and fusing formation of the package bottom have been completed.

Now, turning back to FIG. 1, when the thus bottom-formed semipackage 1 is conveyed to station P7, a conventional discharge unit, not shown, is actuated to discharge the semipackage under consideration therefrom onto conveyor means 31 arranged horizontally at a predetermined small distance below the turret 21. In this position, the surface to which the pouring unit 2 is attached, of the semipackage mounted in position on mandrel 22 is now in parallel with the common rotating plane of all the mandrels, and thus when the semipackage is transferred to the conveyor means 31, while the present positional attitude of the semipackage is kept unchanged, the said surface thereof will be kept in parallel with the carrying direction of the conveyor. Therefore, the semipackage 1 can be carried forward intermittently on the moving conveyor and subjected to successive jobs for liquor-charging and package head assembling. In optional execution of sterilized charging, the empty semipackage will be subjected to a sterilizing treatment in advance of the liquor-charging step per se.

On the other hand, the mandrel 22 now devoid of the semipackage will return to the original station P1 where the bare mandrel is capped again with a new semipackage.

In the present embodiment, as set forth hereinbefore, package bottom fold-in unit 25 comprises a pair of folding arms 26 which are pivotingly, oppositely and symmetrically movable about the central line of the mandrel and in a plane parallel to the common rotary plane of all the mandrels 22; and a folding guide 142 for folding-in, acting upon under pressure or pressing against bottom flaps. And, therefore, triangular bottom panels of the capped-on semipackage 1 under consideration can take such a position relative to the mouting mandrel 22 that an inclined surface to be formed on top of the semipackage may be held in parallel to the common rotary plane of all the mandrels 22, and thus triangular panels 6;6 to be folded inwards at the package bottom are positioned front and rear in the shifting direction of the semipackage-mounting mandrel 22. In this style and arrangement of the semipackage under consideration, the triangular panels 6;6 of the latter are folded under the action of the pivoting folder arms 26 and then, the related bottom flaps 7A;7B are folded together under the pressing action of folding guide 142 for providing and forming necessary folding edge lines. Since the fold-in arms 26;26 and the folding guide 142 are driven by respective and separate drive means, the pivotingly operating strokes of these folding arms may be selected to be larger as desired, regardless of the shifting stroke of the folding guide. Therefore, these arms 26;26 can recede to a certain remote off-service position, so as to provide no hindrance to the shifting movement of the semipackage during the rotary movement of turret 21. The thus prefolded semipackage is separated from the folding guide 142, as the mandrel 22 under consideration moves further, and towards the next succeeding pressure-folding unit 28. During this semipackage-moving period, the outermostly appearing inclined surface of bottom flaps 7A;7B is bound at first by sliding contact with first guide 180 and subjected to a further folding-in effect and then, the outermost tip end of the flap combination 7A;7B will be subjected to a still further binding and folding-in action by sliding contact with second guide 181. As the semipackage consisting of flaps 7A;7B is kept in sufficiently folded-in state in this way, it can be introduced into a small gap space "g" formed between the unit 28 and the front end of mandrel 22 without hindrance, as was referred to hereinbefore and subjected to a sealing and fixing job. Thus, in the present invention, the semipackage capped on the mandrel is kept such that the outermost-appearing inclined surface of the assemblying bottom portion is kept in parallel to the overall rotary plane of the mandrels and subjected to a bottom-folding and shaping step while keeping the foregoing position and thus, can be discharged to the conveyor 31 kept in parallel to the said common rotary plane while keeping the foregoing position per se. And, in this way the inclined surfaces of the semipackage head are positioned at both the sides of the semipackage-conveying direction. In this way, otherwise necessary additional turning treatment of the semipackage by 90-degrees can be avoided definitely, resulting in a highly compact structure of the whole arrangement in comparison with conventionally available similar machines.

In the spout supply unit as set forth hereinbefore, the lower most one of a series of mutually contacting spouts in the chute is taken out from the delivery opening provided at the lower end thereof onto a slider which is shiftable to a certain spout-take-out position remote from the chute. In this way, the spout mounted provisionally on the slider can be separated effectively from the remaining spout series in the chute and taken out from the slider by means of a vacuum pad or the like sucker and in a highly reliable manner.

Further, with use of the spout take-out and attaching unit as set forth hereinbefore, while operates in such a way that during intermittent rotation of turret 51 carrying thereon a plurality of semipackages 1, the jobs for successive spout-introduction into these semipackages and for sealing attachment of spouts thereto, can be executed, a highly convenient and efficient spout-attaching possibility being realized. In this case, again as referred to hereinbefore, the turret 51 has such a structure as capable of holding semipackages in parallel to the central axis X—X of rotation of the turret. By arranging the turret to direct its central axis horizontally, it is possible to construct it so as to have its axial length only slightly longer than the longitudinal length of the semipackage under treatment and to arrange it midway at a properly selected intermediate position in a horizontal semipackage-conveying route, as most clearly shown in FIG. 5, and thus the whole apparatus can have a highly compact overall arrangement. In addition, semipackage introduction into and discharge from one of the package holders on the turret 51 may be carried out in an easy and simultaneous manner which accelerates the whole package forming and processing jobs.

In addition, the spout-attaching unit so far shown and described may be arranged outside of the sterilized chamber arranged upstream of the package bottom assemblying unit of a package assembly, liquor-charging and seal-off arrangement so that the sterilization of the semipackages may be executed only after spout-attaching job, thereby assuring a highly safe and effective liquor charging under sterilized conditions.

In the foregoing embodiment, spout supply unit 13, FIG. 2, has been so designed and arranged that spouts 2 are supplied through a chute 14 under gravity action. However, in practice, spout-supplying work can be executed in reliance on other kind of spout feeder. Such a modified structure of spout-feeder will be illustrated hereinbelow with reference to FIGS. 35 through 39. In this modification, spouts are fed successively piecewise by means of chain conveyor means.

Figure 35:
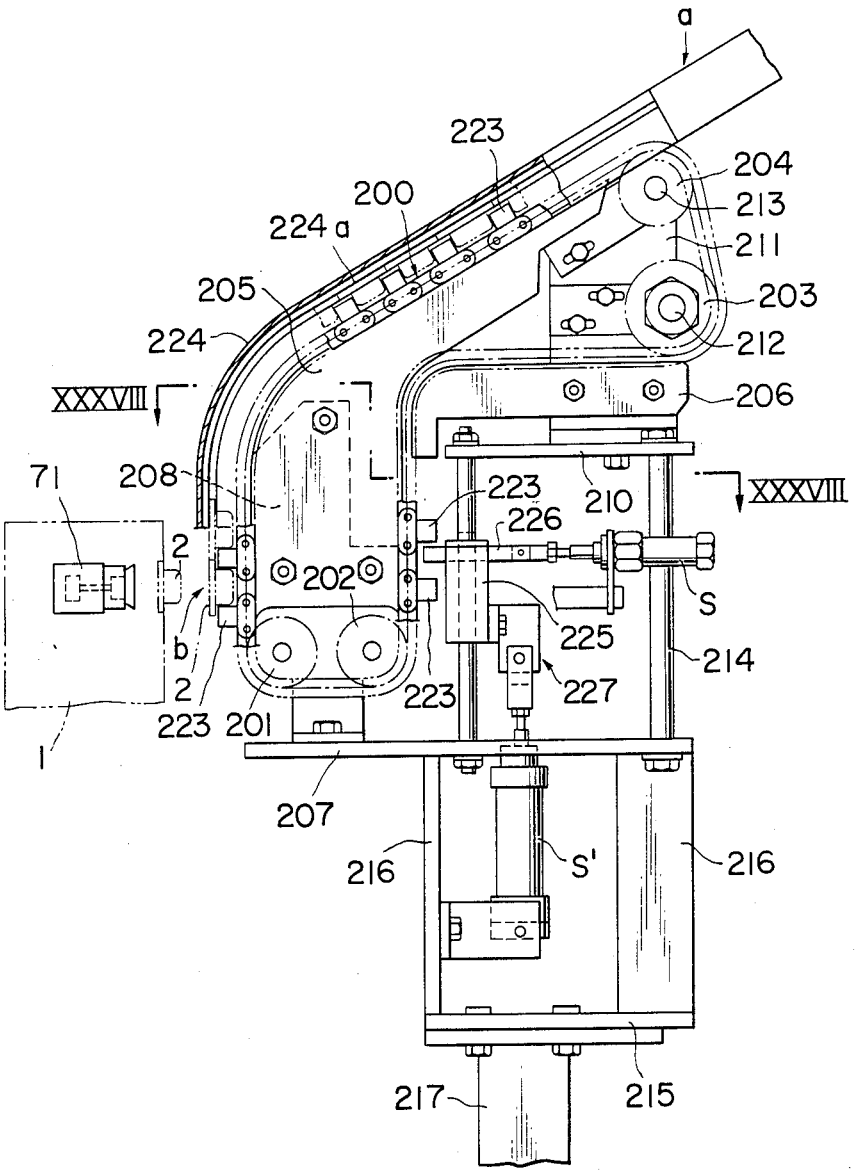
FIG. 35 is a partly sectioned elevational view of a spout feeding chain conveyor system which is a modification of the spout-gravity feed chuting mechanism.

In FIG. 35, a chain conveyor 200 is shown which is in engagement with a lower sprocket wheel pair 201;202 and an upper sprocket pair 203;204 to provide a closed conveyor chain circuit. An inside guide plate 205 is provided for better guiding the range of chain defined between sprocket wheels 201 and 204. In the similar chain guide purposes, a outer guide plate 206 is provided for better guidance of substantial part of the chain ranged between sprocket wheels 202 and 203.

Figure 36:
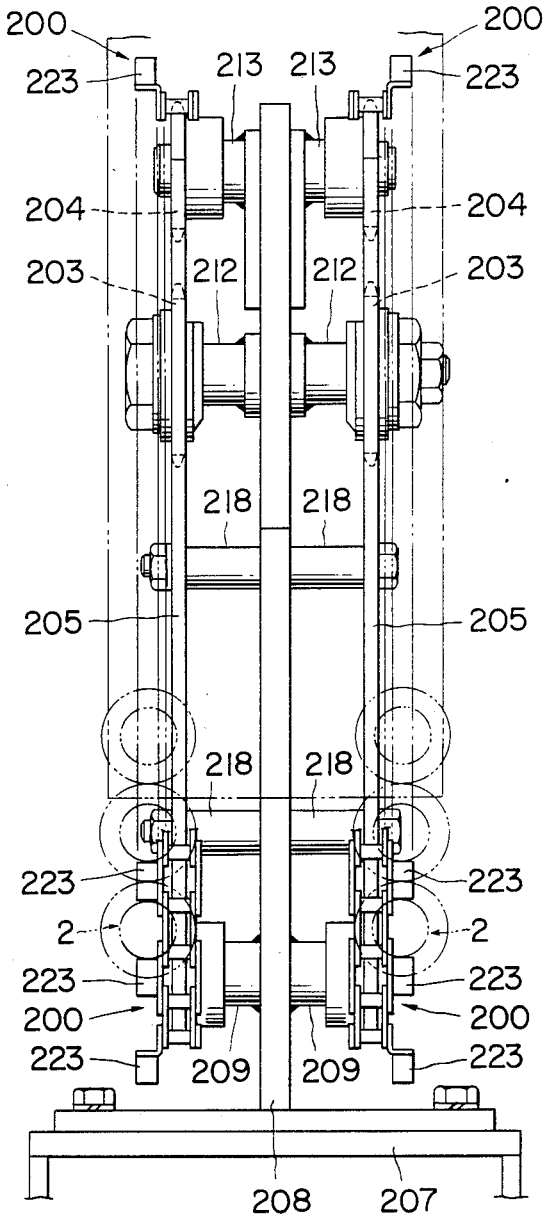
FIG. 36 is an enlarged elevational view showing several preferred parts appearing in FIG. 35.
Figure 37:
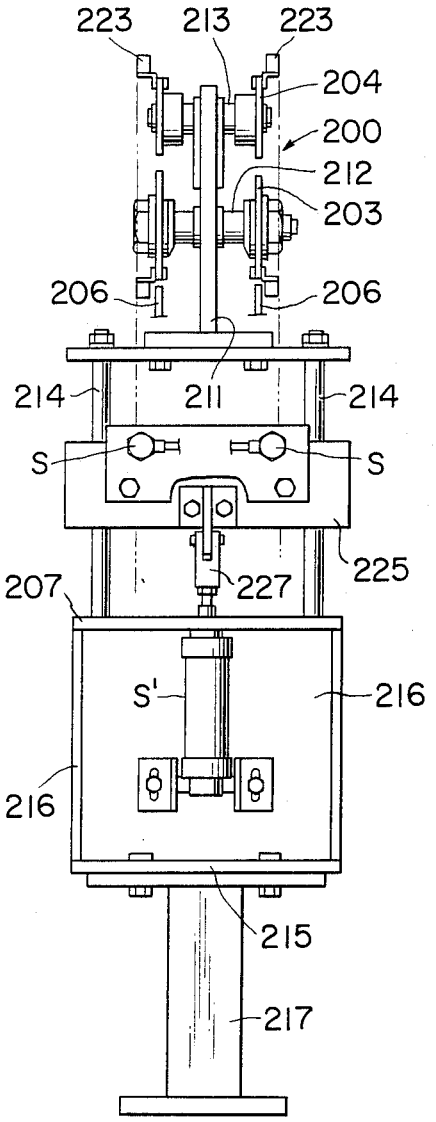
FIG. 37 is an end view of the mechanism illustrated in FIG. 35.
Figure 38:
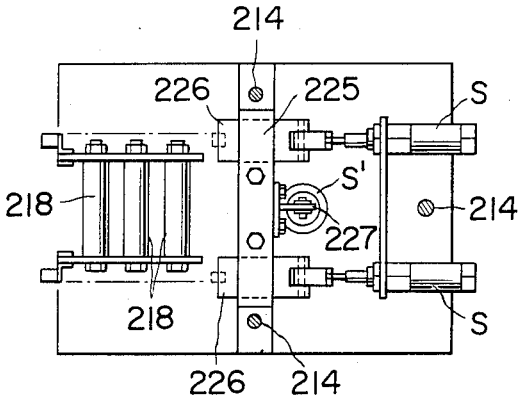
FIG. 38 is a plan view of a part of the mechanism shown in FIG. 35.

As may be well seen from FIG. 36, the chain conveyor system is, in fact, arranged in two parallel rows. Sprocket wheels 201;202 are supported rotatably on respective support arms 209, FIG. 36, which extend laterally from a common support plate 208, fixedly attached to a base plate 207. On the other hand, sprocket wheels 203;204 are rotatably mounted on respective and adjustable support arms 212;213 which are rigidly supported on support plate 211 extending vertically from an upper plate 210.

As shown in FIG. 35, the upper pllate 210 is arranged in parallel to the base plate 207, four pillars 214 extending rigidly between these plates 207 and 210. Base plate 207 is supported rigidly on a further and smaller base plate 215 through three support plates 216.

Base plate 215 is supported from below by an upstanding main pillar 217, as shown in FIG. 35. Guide plates 205 are supported through a plurality of spacer rods 218 by a support plate 208 and at both the sides thereof. Guide plate 206 is supported by a support plate 211 and at both the sides thereof in the similar manner.

Figure 39:
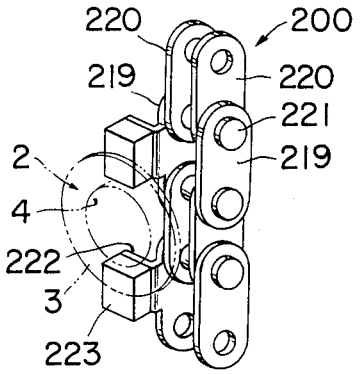
FIG. 39 is an enlarged perspective view of a part of the chain conveyor shown in FIG. 37.

As shown in FIG. 39, each of two parallel conveyors 200 consisting of the chain conveyor system comprises a series of spaced outer link plates 219 and inner link plates 220 and a number of connecting link pins 221, as conventionally. At an outer side of each link plate 219, an outwardly extending angular projection 222 is formed on or attached fixedly with, a support piece 223 being firmly attached thereto as shown. Between two neighboring support pieces 223, a spout 2 is caught and held in position by its cylindrical portion 4 for being carried along with spout-conveying movement of the chain conveyor.

Although the cylindrical main portion 4 of each of spout units is shown only by its outer configuration, in practice, each of these main portions may be fitted with a pull open spout nozzle and/or screwed cap and the like conventional means. Naturally, this feature may be embodied in substantially all the spout units 2 shown and/or described herein.

The spout-conveying range starting from the uppermost sprocket wheel 204 arranged nearly at the effective starting end "a" of the chain conveyor system, where, although not shown, a spout accumulation magazine may preferably be fitted on, and ending directly above the spout-sucking and delivery section "b", is covered with an elongated covering 224 formed with a correspondingly long slit **224*a* adapted for guiding the flange portions 3 of spout series 2**, in a sliding manner.

The circulating motion of the chain conveyors 200 may be carried out in the following manner:

With actuation of a pressure air cylinder S mounted fixedly on a vertical slide 225 which is slidable to-and-fro on and along one of the support pillars 214, a horizontally arranged slide plate 226 passing through the vertical slide 225 is pushed forward and the tip end of the horizontal slide 226 is introduced into an idle gap between two successive support pieces 223.

Vertical slide 225 is connected through a connecting rod 227 with a pressure air cylinder S' supported by one of support plates 216. With actuation of the air cylinder S', the slide 225 is driven to move along the support pillar 224.

Thus, under the conditions as shown, when the air cylinder S' is actuated so as to move the vertical slide 225 upwards, the tip end of the plate 226, kept in contact with the upper support member 223 causes the latter to move upwards, thereby shifting the chain conveyor 200 one step. When vertical slide 225 has been driven upwards by one step, the air cylinder S is actuated so that the engageable plate 226 is receded rightwards in FIG. 35, thereby the tip end thereof being disengaged from contact with support piece 223.

At this instance, another pressure air cylinder S' is actuated so that vertical slide 225 performs a downward movement along the related support pillar 214.

With each execution of a foregoing rectangular motion cycle of the engageable plate 226, the conveyor chain 200 is caused to perform one pitch shift movement and so on. Therefore, the conveyor chain 200 can execute a series of intermittent shifting motion.

At the spout-sucking supply secton "b" for spout member 2, the chain cover 224 is partially broken away so as to provide an opening, to which a sucker unit 71 is arranged in an opposed relationship from outside.

In the following, the operation mode of the present modification will be set forth.

With actuation of air cylinders S and S' which are of the double-acting type, in FIG. 35, the engageable plate 226 attributed to the cylinder S will perform cyclic motion in the shape of a rectangle, thereby the tip end of the plate 226 pushing, each time of the moving cycle, the support piece 223 on outer link plate 219 of the chain conveyor 200 upwards by one pitch or step. Thus the chain conveyor system performs an intermittent and partial cyclic motion when seeing the whole conveyor system as was referred to hereinabove.

As a number of spouts flow down from above and off the magazine, to the effective starting point "a", the main cylindrical portion 4 of each spout unit 2 is forcibly introduced into idle gap provided between two neighboring support pieces 223 on outer link plate 219 of the chain conveyor 200, as specifically shown in FIG. 39, while the flange portion 3 of each spout unit 2 is kept in contact with the elongated slit 24*a*, thereby the spout series being fed forward in an intermittent manner.

When a spout 2 is intermittently fed to the sucking station "b" where the cover 224 is partially broken away so as to represent a spout-delivery opening, sucker 71 is actuated for receiving suckingly the now arrived spout 2. Upon returning movement of the sucker 71 carrying the spout to the original position, a semipackage 1 is advanced, as was referred to hereinbefore. With rightward advancing movement of the sucker 71 as seen in FIG. 35, the cylindrical main portion 4 of the carried spout 2 is introduced into an attaching opening, as was referred to, for the purpose of attaching the spout onto the semipackage 1. When the sucker 71 returns to its original position, the semipackage 1 will recede to the next step job. The timing for joint actuation of two air cylinders S and S' for execution of a rectangular cyclic movement schema of the engageable plate member 226; for take-out of each spout 2 by the sucker 71 and attaching it to the semipackage 1 and the like related jobs are controlled by properly selected electronic control means, not shown.

In place of the intermittent stepwise cyclic movement of a conveyor chain system as at 200, so far shown and described, a timing belt having on its outer surface a series of spaced recesses or projections adapted for receiving a number of spouts by their cylindrical spout propers may be used. This timing belt is driven by an intermittent stepwise rotating pinion or the like member which is driven through a mechanical combination of a reciprocating rack member shown as at 150 in FIG. 23; a cam clutch and a pressure air cylinder.

By employing the forced drive mechanism for stepwise conveyance of a large number of spouts by means of conveyor chain, timing belt or the like, in place of the gravity action mode chuting system, shown in FIG. 2, clogging of spouts at joints in conveying routes, and overlapped flange portions of spouts as may occur during conveyance thereof, with deformed spout flanges or the like causes.

On the other hand, by replacing outside link plates with properly modified ones mutual positioning and proper modification of support members for holding the conveying spouts of different size and configuraion may be easily attained.

What is claimed is:

1. A process for assembling and liquor charging of a series of paper packages, comprising:

successively attaching a spout onto a closable top end portion of each of said packages, each of said packages having a hollow, square cylindrical main body, with closable top and bottom end portions, outside and inside surfaces of each of said packages being coated with a sealable, settable agent;

introducing a flanged spout into a reception opening formed at a specifically selected position of each of said packages through a wall or flap portion thereof;

sealingly attaching said flanged spout onto the wall or flap portion of each of said packages;

successively capping each of said packages onto tip ends of a plurality of radial mandrel arms forming an intermittently rotatable mandrel unit, said capped packages being directed radially outward;

assembling and shaping said bottom end of each of said packages in capped position on the related mandrel arm;

discharging each of said bottom-assembled packages onto a conveyor means;

charging a liquor into each of said bottom-assembled packages mounted on said conveyor means; and assembling and shaping said top end portion of each of said packages.

2. The process of claim 1, further comprising:

spraying a solution of a sterilizer agent onto said inside surfaces of each of said packages; and drying said applied sterilizer solution prior to said liquor charging step.

3. The process of claim 1, wherein each of the packages is capped on the tip end of one of the mandrel arms of the mandrel unit such that a surface of the top end portion of the package, which is to be attached fusedly with a spout, is kept in parallel to the rotary plane of the mandrel unit.

4. The process of claim 1, wherein the conveyor means forwards each of said packages in the direction of the longitudinal axis thereof and, while holding its linearly advancing movement, introducing said package in holder means mounted on a turret through a sliding movement; and subjected the package to an intermittent rotational movement by the corresponding movement of the turret; and fusingly attaching a spout to each of the packages.

5. The process of claim 1, wherein, while said packages are individually held on the plurality of radially extending mandrel arms of the mandrel unit and subjected to intermittent rotary movement, applying heat thereto at the bottom end portion of each of the packages prior to the package bottom assembling step.

6. The process of claim 1, wherein the package bottom assembling step comprises the step of forming a folding line, folding-in the thus fold-line formed package bottom; applying pressure thereto; and fusingly uniting the package bottom into a desired final shape.

7. An apparatus for successive and piecewise attachment of flanged-spouts onto a number of paper-made semipackages, each in the form of a square-cylindrical hollow member coated with heat-sealable agent on outer and inner wall surfaces thereof, comprising:

a turret comprising a plurality of semipackage holders arranged equidistantly around a central axis of said turret at a constant distance therefrom for holding each of said semipackages lengthwise in parallel to said central axis;

drive means for rotating said turret intermittently so as to position each of said holders at three different provisionally halted positions, the first one thereof being a semipackage receiving and discharging position, the second one thereof being a spoutintroducing position and the third one thereof being a spout-sealing position;

semipackage introducing and discharge means for discharge of a semipackage from the semipackage holder halted provisionally at said semipackage receiving and discharging position and for supplying a new semipackage;

spout-introducing means arranged at a position on an extension line from the semipackage provisionally held on the holder halted at said spout-introducing position;

semipackage-advancing means for shifing said semipackage held on said holder and as a whole in unison to a position where a spout is introduced by means of said spout-introducing means;

semipackage receding means for returning said semipackage to its initial position;

spout-sealing means arranged in proximity of an extension line of the semipackage held on a holder provisionally halted at said spout-sealing position;

further semipackage advancing means for shifting said semipackage held on said semipackage holder and as a whole in unison to a position where a spout is sealingly attached to said semipackage under the action of said spout-sealing means; and further semipackage receding means for returning said spout-attached semipackage to its original position.

8. An apparatus for assembling and liquor-charging of paper packages, comprising:

feeder means for feeding individually a series of paper packages held horizontally, each of said packages having closable open top and bottom end portions, said top end portion having a small lateral opening;

holding means for holding each of said packages individually horizontally;

sucker means shiftable relative to said package on said holding means and partially projectable into the top end portion of said package for introducing a cylindrical main portion of a spout held on a tip end of said sucker means into said small lateral opening;

attaching means for fusingly attaching said spout onto said top end portion of said package from inside of said package;

a mandrel unit arranged downstream of said holding means and having a plurality of radially extending mandrel arms rotated intermittently by said mandrel unit;

capping means for causing the package to be capped on one arm of said mandrel unit such that said bottom end portion of said package is directed radially outward;

assembly means for assembling said bottom end portion of said package while the package is mounted on said mandrel unit and subjected to the intermittent rotary motion thereof;

conveyor means for conveying the bottom-assembled package;

holding means for holding said package on said conveyor means such that its bottom end portion is directed downward;

liquor-charging means for charging a liquor into said package through the top end portion thereof while the package is being conveyed on said conveyor means; and means for assembling the top end portion of said package while the package is being conveyed on said conveyor means.

9. An apparatus of claim 8, further comprising feeding means for successively feeding spouts to said sucker means.

10. The apparatus of claim 9 wherein said feeding means comprises:

a chute containing and for guiding a number of said spouts, and having at a lower end thereof a delivery opening for individually feeding-out said spouts;

a slider arranged in proximity of said lower end of the chute and formed with a reception space for receiving successively, individually and intermittently said spouts through said delivery opening; and a slider drive unit for positioning said slider at two different positions, one position being a spout reception position where said reception space is aligned with said delivery opening of the chute, and the other position being a stock-taking out position offset from said spout delivery opening; said slider having a spout surface preventing dropout from the chute through said delivery opening when said slider is not in said spout receptin position.

11. The apparatus of claim 9 wherein said feeding means comprises chain conveyor means extending in close proximity to said sucker means for intermittent feeding of the spouts to the sucker means, said chain conveyor means having outside and inside chain link members, said outside chain link members having laterally projecting support members, such that two neighboring support members provide between them a space for accommodating and supporting each of said spouts.

12. The apparatus of claim 8 wherein said assembly means comprises:

heater means for heating the bottom end portion of said package while the package is held on said mandrel with said bottom end portion directed radially outward;

folding line forming means comprising a pair of pawl-ended arms arranged downstream of said heater means at a specifically selected halt position for each of said mandrels and pivotable reciprocatingly in a plane parallel to a common rotary plane of said mandrels, said folding line forming means acting upon the bottom end portion of said package and folding a pair of triangular bottom panels toward each other to close the bottom end portion of the package;

a folding guide shiftable along a central axis of the mandrel unit and toward the mandrel unit from outside thereof for folding-in a pair of bottom flaps;

first drive means for driving said pawl-ended arms in reciprocating rotary movement;

second drive means for driving said folding guide in a linear reciprocating movement;

pressure fold-in means arranged in proximity to one of said mandrel halting positions and downstream of said folding line forming means, to form a folded-in package bottom end portion; and guide means disposed between said folding line forming means and said pressure fold-in means to apply pressure to the thus substantially folded-in package bottom end portion which is being carried along while the mandrel is subjected to rotary movement.

* * * * *